United States Patent [19]

Paepke

[11] 4,017,038

[45] Apr. 12, 1977

[54] TENSIONING DEVICE FOR TRAVELING YARNS AND THE LIKE

[76] Inventor: Horst Paepke, Fasanenweg 30, 7470 Rottenburg, N., Germany

[22] Filed: Mar. 26, 1975

[21] Appl. No.: 562,242

[30] Foreign Application Priority Data

Mar. 14, 1975 Germany ..... 2511162

[52] U.S. Cl. ..... 242/152.1

[51] Int. Cl.[2] ..... B65H 59/22

[58] Field of Search ..... 242/152.1, 147 R, 149

[56] References Cited

UNITED STATES PATENTS

| | | | |
|---|---|---|---|
| 1,490,512 | 4/1924 | Hill et al. | 242/152.1 |
| 1,785,987 | 12/1930 | Stewart | 242/152.1 X |
| 2,373,513 | 4/1945 | Stevenson | 242/152.1 |
| 3,753,535 | 8/1973 | Zollinger | 242/152.1 |
| 3,874,613 | 4/1975 | Zollinger | 242/152.1 |
| 3,892,371 | 7/1975 | Zollinger | 242/152.1 |

FOREIGN PATENTS OR APPLICATIONS

| | | | |
|---|---|---|---|
| 19,365 | 1909 | United Kingdom | 242/152.1 |

*Primary Examiner*—Stanley N. Gilreath
*Attorney, Agent, or Firm*—Michael J. Striker

[57] ABSTRACT

At least two yarn-guiding eyelets are coaxially arranged one above the other, so that the yarn travels through the center passage of at least the lower eyelet. Located between the two eyelets is a spherical member which straddles the upper open end of the passage in the lower eyelet and has freedom of movement laterally of the space which is defined between the two eyelets, but is prevented from falling out of this space by the presence of the upper eyelet.

7 Claims, 5 Drawing Figures

TENSIONING DEVICE FOR TRAVELING YARNS AND THE LIKE

BACKGROUND OF THE INVENTION

The present invention relates generally to a device for tensioning traveling yarns and the like.

It is known from the prior art to provide such a device which is utilized to tension a running or traveling yarn in a textile machine. This prior-art device has a yarn passageway made up of three sections. Each of these sections has a progressively larger diameter from the inlet end of the device. A small diameter section at the entrance end of the device has a seat adjacent the inner end thereof, and a spherical element is received on this seat. The medium diameter section surrounds the seat and retains the spherical element therein. The larger diameter section of the passageway is sufficiently large to enable pressurized air to pass over the spherical element without forcing the element out of the end of the passageway. The wall adjacent the junction of the large and medium diameter sections is tapered so as to permit radial return of the spherical element to the medium diameter section to reside on the seat. A mounting arrangement is provided for securing the device to a yarn handling machine. As the yarn passes through the three sections of the yarn passageways, it is engaged in the medium diameter section by the spherical element, which impedes the yarn progress. Thereby, the yarn is tensioned.

The difficulty of this prior-art arrangement is that the spherical element is laterally completely surrounded by the wall bounding the yarn passageway. Lateral displacement of the spherical element to any appreciable extent is possible only if the spherical element moves axially away from the inlet opening to a substantial degree, that is into the passage section having the next larger diameter. This in itself would not be inherently too disadvantageous, except that the fact that the spherical element is laterally completely surrounded by the wall bounding the passageway of course means that the passageway is closed in lateral direction. It has now been found that under these circumstances the passageway becomes rapidly clogged with fibers and the like which prevent the free movement of the spherical element. As soon as there is any interference with this free movement, however, the device is no longer capable of controlling the tension on the yarn, i.e., as acting as a yarn brake with a braking or tensioning effect which is determined by the weight of the spherical element. The prior-art device has a further disadvantage, namely the fact that because of the three-section yarn passageway it must be relatively tall. Still another disadvantage is the fact that despite the lateral closure of the passageway, there is still a danger that the spherical element might fall out of the device under certain circumstances.

SUMMARY OF THE INVENTION

It is a general object of this invention to avoid the disadvantages of the prior art.

More particularly, it is an object of the present invention to provide an improved tensioning device for yarns and the like, utilizing a spherical element but being so constructed that there will be no interference with the proper operation of the device and movement of the spherical element under any circumstances.

A further object of the invention is to provide such a device which is of relatively small dimensions.

Another object of the invention is provide such a device which requires an absolute minimum of maintenance.

In keeping with these objects, and with others which will become apparent hereafter, one feature of the invention resides in a tensioning device for traveling yarns and the like which, briefly stated, comprises first means forming a yarn passage having an inlet and an outlet, a spherical member straddling said inlet to control the tension of a yarn traveling through the passage, and second means defining with the first means at the inlet thereof a chamber for the spherical member which has at least two opposite open sides. The second means is spaced from the inlet by a distance so selected that the spherical member is prevented from moving out through the open sides.

Since the chamber has at least two opposite open sides, or can even be completely open in longitudinal direction, it is impossible for it to become clogged by accumulation of fibers and the like; this means that the free movement of the spherical member cannot be hindered in any way and the device can therefore not be prevented from properly functioning.

The first and second means may each be in form of at least one eyelet. The passages of the eyelets can then be arranged coaxially, and if so constructed the device will have two yarn-tensioning stages wherein the yarn is tensioned to different extents. The lower tensioning stage is reached when the yarn travels through the passage of the lower eyelet through the outlet thereof past the spherical member, and then laterally out of one of the open sides of the chamber. If it is decided to utilize the second yarn tensioning stage, then the yarn is not led laterally out of the chamber, but instead is led into the upper eyelet and through the same.

In operation, the spherical member turns under the frictional influence of the yarn and, in effect, has only point contact with the edge bounding the outlet of the passage of the first means. The spherical member thus provides an equalization of yarn tension if the yarn or thread cannot be pulled off a supply bobbin at uniform tension, so that the bobbin tends to intermittently briefly retard the yarn and for those times causes an increase in the yarn tension. The higher reaction force which results from this tension increase at the supply side of the device causes a stronger engagement of the spherical member with the edge of the seat provided for the spherical member. This, in turn, results in a reduction of the amount of weight of the spherical member which rests upon or acts upon the traveling yarn, and thus results in an equalization of the increased reaction force upon the yarn, so that the tension of the yarn, at which the yarn leaves the device, is at least substantially maintained constant.

If desired, the device of the present invention can be provided with additional stages having differential tensioning forces, simply by providing additional eyelets which cooperate with additional ones of the spherical members so that the yarn must travel through all of these eyelets. It is advantageous if several of the eyelets in such case are arranged vertically spaced from one another so that each upper eyelet always constitutes the second means which, in cooperation with the lower eyelet, prevents the lateral escape of the spherical element located between them. Depending upon the amount of tension that is desired to be exerted upon the yarn, the yarn can be made to pass through all of the eyelets, or only through some of them.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
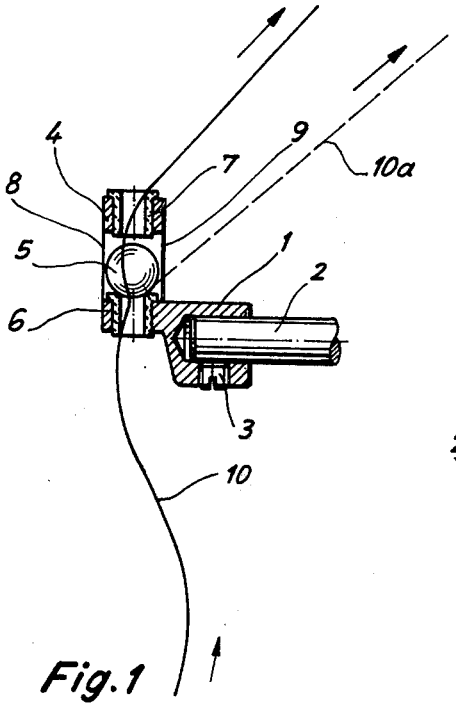
FIG. 1 is an axial section illustrating one embodiment of the invention having a single yarn-tensioning stage.

FIG. 1 illustrates one embodiment of the invention which is provided with a mounting member 1 that can be placed onto a support rod 2 and secured thereon by means of a screw 3. The mounting member 1 is connected with an element 4 which forms a cage or chamber for a metallic spherical member which constitutes a yarn-tensioning element. The spherical member 5 is seated on the upper outlet end of the passage formed in a yarn eyelet 6 which advantageously consists of sintered ceramic and which is mounted in vertical orientation in a bore formed in the member 4. A second eyelet 7 is arranged above the spherical element 5, its passage being coaxial to the passage of the lower eyelet 6.

The chamber 4 is formed at least at two opposite sides of the spherical member 5 with outlet openings 8 and 9. These outlet openings are large enough so that the spherical member 5 might escape laterally through them. However, such escape is prevented by the presence of the upper eyelet 7 which is spaced from the upper outlet end of the passage, in the eyelet 6, on which outlet end the spherical member 5 is normally seated, by such a distance that the lower edge bounding the passage in the eyelet 7 engages the spherical member 5 and prevents the latter from exiting through the openings 8 or 9, as soon as the spherical member 5 has moved laterally with reference to the center of the passage in the lower eyelet 6 by an extent which corresponds approximately to, but does not exceed the radius of the passages in the eyelets 6 and 7.

Figure 3A:
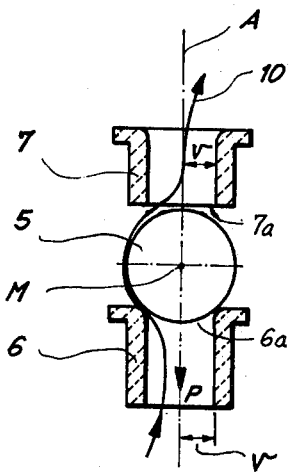
FIG. 3*a* is a diagrammatic axially sectioned detail view showing the spherical member in one extreme position.
Figure 3B:
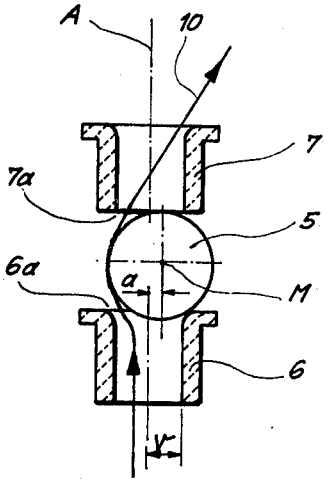
FIG. 3*b* is a view similar to FIG. 3*a* showing the spherical member in another extreme position.

FIGS. 3*a* and 3*b* show this most clearly, in that they illustrate the spherical member 5 in its two extreme operating positions. FIG. 3*a* shows the spherical member 5 in its rest position in which it is seated to straddle the upper outlet opening 6*a* of the passage in the lower eyelet 6. In this position, the center M of the spherical member 5 is located on the common axis A of the passages in the eyelets 6 and 7. Under the influence of tension acting upon it from a yarn 10 that travels through the device, the spherical member 5 can be laterally displaced from this central rest position to the extreme end position shown in FIG. 3*b* in which the spherical member 5 abuts the lower edge 7*a* bounding the inlet opening to the passage of the upper eyelet 7. At this time, the spherical member 5 has been laterally shifted through a distance *a* which corresponds substantially to—but does not exceed—the radius *r* of the passage in the eyelet 6, and also in the eyelet 7 in this case since the passages are identical. To permit small radial movement of the spherical member 5, and also to avoid damage to the yarn 10, the edges bounding the openings in the passages of the eyelets 6 and 7 are slightly rounded or beveled.

It will be appreciated that the tensioning effect exerted by the device upon the yarn 10 is primarily a function of the portion of the weight of the member 5 that acts upon the yarn 10. Evidently, the portion of the weight of the member 5 acting upon the yarn 10 is greatest when the member 5 is in the position of FIG. 3*a* and is least when the member 5 is in the position of FIG. 3*b*. In addition, there is a friction effect acting upon the yarn 10. It will be clear that the yarn tension can be selected to be greater or lesser, depending upon whether the yarn is made to pass through both of the eyelets 6 and 7, as shown by way of the broken line 10 in FIG. 1, or is made to pass only through the lower eyelet 6, past the spherical member 5 and out through one of the lateral openings 8 or 9 as shown by way of the broken line 10*a* in FIG. 1.

When there are momentary tension peaks in the yarn, resulting from momentary retardation of the yarn as it is being pulled off an improperly wound bobbin or the like, these tensions peaks are equalized by the device of the present invention. This is the result of shifting of the spherical member 5 under the influence of the momentary tension peaks acting upon the yarn at the inlet side or supply side of the device. The displacement of the spherical member 5 in direction towards its extreme position shown in FIG. 3 the proportion of the weight of the spherical member 5 acting upon the yarn 10 varies, and as a result the tension of the yarn in the region of the spherical member is decreased; this results in a compensation for the higher tension acting at the inlet side upon the yarn.

Figure 2:
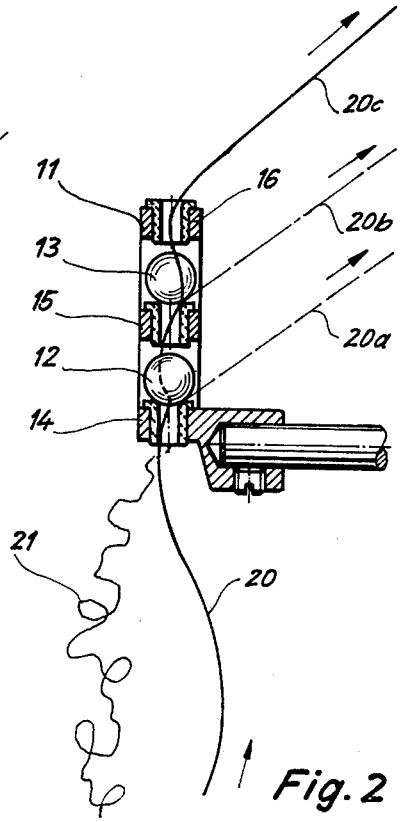
FIG. 2 is a view similar to FIG. 1, but illustrating an embodiment having two yarn-tensioning stages.
Figure 2A:
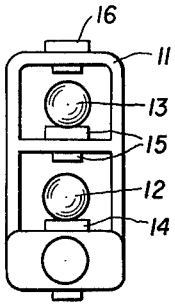
FIG. 2*a* is a side view of FIG. 2.

The embodiment in FIG. 2 and FIG. 2*a* operates in the same manner as the one in FIG. 1, and therefore the operation need not be separately described. In this embodiment, however, the device has a cage 11 for two vertically spaced spherical members 12 and 13. Each of these is seated on an eyelet 14 or 15, respectively. The eyelet 15 serves also as the second means which cooperates with the lower spherical member 12 and prevents the same from moving laterally out of the cage 11. The spherical member 13 is prevented from escaping out of its cage 11 by the presence of the third eyelet 16. The embodiment in FIG. 2, and FIG. 2*a* therefore, has three stages so that at the will of an operator the yarn can be subjected to a single-stage tensioning effect, a dual-stage tensioning effect or a triple-stage tensioning effect, as indicated by the lines 20*a*, 20*b* and 20*c*, respectively. In each of these stages, a different tensioning effect is obtained upon the yarn.

The device according to the present invention is capable of controlling the tension of yarns, which term includes, of course, threads, filaments and the like, of the different and characteristics, including stretch yarns 21. FIG. 2 shows such a stretch yarn 21 in its typically crimped condition which it assumes when it is not subjected to axial stretching. The device of the present invention with its freely movable spherical element or elements assures a reliable tensioning of such a stretch yarn 21, and thus elimination of the crimp for the duration of the tensioning, without any danger that knots might form.

It will be understood that each of the elements described above, or two or more together, may also find a useful application in other types of constructions differing from the type described above.

While the invention has been illustrated and described as embodied in a tensioning device for yarns and the like, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tensioning device for traveling yarns and the like, comprising first means forming a yarn passage having an inlet and an outlet; a spherical member straddling said outlet to control the tension of a yarn traveling through said passage; second means defining with said first means at said outlet thereof a chamber for said spherical member which has at least two opposite open sides; and third means spaced axially from said outlet by a distance so selected that said spherical member is prevented from moving out through said open sides.

2. A device as defined in claim 1, wherein said first means comprises a first eyelet, and said third means comprises a coaxial second eyelet.

3. A device as defined in claim 1, wherein each of said first and third means comprises at least one eyelet, the passages of all of said eyelets being coaxial and said yarn being adapted to travel seriatim through all of said passages.

4. A device as defined in claim 1, each of said first and third means comprising an eyelet; further comprising at least one additional eyelet adjacent one of said first and third means and said second means forming with said one additional eyelet another chamber similar to the first-mentioned chamber; and another spherical element received in said other chamber, said eyelets all being coaxial and said yarn being adapted to travel seriatim through all of said eyelets.

5. A device as defined in claim 1, wherein said spherical member is free to move laterally of the center of said outlet by a distance substantially equal to, but not exceeding the inner radius of said passage.

6. A device as defined in claim 1, wherein said outlet is bounded by an annular edge which forms a seat for said spherical member.

7. A device as defined in claim 6, wherein said edge is shaped to guide said spherical member back to a position in which it is centered on said outlet, upon movement of said spherical element laterally of said outlet.

* * * * *